US006075866A

United States Patent [19]

Frasl et al.

[11] Patent Number: 6,075,866

[45] Date of Patent: Jun. 13, 2000

[54] ELECTROACOUSTIC TRANSDUCER HAVING AXIALLY EXTENDING CORRUGATED SUPPORTING MEANS FOR THE DIAPHRAGM

[75] Inventors: Ewald Frasl, Biedermannsdorf; Erich Klein, Himberg, both of Austria

[73] Assignee: U.S. Philips Corporation, New York, N.Y.

[21] Appl. No.: 09/251,234

[22] Filed: Feb. 16, 1999

[30] Foreign Application Priority Data

Feb. 17, 1998 [EP] European Pat. Off. ..... 98890044
Feb. 17, 1998 [EP] European Pat. Off. ..... 98890045

[51] Int. Cl.[7] ..... H04R 25/00

[52] U.S. Cl. ..... 381/177; 381/423; 381/398; 181/171

[58] Field of Search ..... 381/398, 430, 381/423, 369, 342.162; 181/171

[56] References Cited

U.S. PATENT DOCUMENTS 5,162,619 11/1992 Thiele et al. ..... 181/166
5,303,209 4/1994 Frasl ..... 381/369

FOREIGN PATENT DOCUMENTS 1085193 11/1958 Germany .
61195100 8/1986 Japan ..... H04R 7/20

*Primary Examiner*—Curtis A. Kuntz
*Assistant Examiner*—Dionne N. Harvey
*Attorney, Agent, or Firm*—Edward W. Goodman

[57] ABSTRACT

In an electroacoustic transducer (1) having a diaphragm (19) and having a supporting means (25) for the diaphragm (19) the diaphragm (19) and the supporting structure (25) form a single part, and an annular outer zone (24) of the diaphragm (19) and a first annular zone (26) of the supporting structure (25) adjoin one another smoothly.

17 Claims, 2 Drawing Sheets

ELECTROACOUSTIC TRANSDUCER HAVING AXIALLY EXTENDING CORRUGATED SUPPORTING MEANS FOR THE DIAPHRAGM

The invention relates to an electroacoustic transducer comprising a housing and comprising a voice coil and comprising a diaphragm which is intended for cooperation with an air mass in an acoustic free space situated in front of the diaphragm and which can be set into vibration by means of the voice coil substantially parallel to a direction of vibration and which comprises an annular outer zone and comprising supporting means for the diaphragm for securing the diaphragm to the housing, which supporting means have a first annular zone connected to the annular outer zone of the diaphragm, and a second annular zone connected to the housing, and a connecting zone which connects the first annular zone and the second annular zone to one another, which connecting zone has an at least substantially corrugated cross-sectional shape and has an orientation which corresponds at least substantially to the direction of vibration of the diaphragm, and is further elastically compliant parallel to the direction of vibration of the diaphragm.

The invention further relates to a diaphragm for an electroacoustic transducer, which diaphragm is intended for cooperation with an air mass in an acoustic free space situated in front of the diaphragm and which can be set into vibration by means of a voice coil substantially parallel to a direction of vibration and which comprises an annular outer zone intended to be secured to supporting means for the diaphragm, by which supporting means the diaphragm can be secured to a housing of an electroacoustic transducer.

Such an electroacoustic transducer of the type defined in the first paragraph and such a diaphragm of the type defined in the second paragraph are known, for example from the document JP 61-195.100. The supporting means of the known transducer, which is a loudspeaker having a large volume, and of the diaphragm known from this known transducer are formed by cross-sectionally corrugated supporting bellows comprising three corrugations in total and formed as a part which is separate from the diaphragm. Owing to this separate construction of the diaphragm and the supporting bellows it is necessary to join the diaphragm and the supporting bellows to one another during the manufacture of the loudspeaker, which must be effected very accurately in order to guarantee a correct and unimpeded vibration of the voice coil of the loudspeaker in the air gap of the magnet system of the loudspeaker. Moreover, this joining of the diaphragm and the supporting bellows requires a separate operation, which is unfavorable in view of a low-cost and simple production.

It is an object of the invention to preclude the above-mentioned problems with an electroacoustic transducer of the type defined in the first paragraph and with a diaphragm of the type defined in the second paragraph and to provide an improved electroacoustic transducer and an improved diaphragm, the resulting improvements being particularly manifest in the case of miniaturization of an electroacoustic transducer.

According to the invention, in order to achieve the afore-mentioned object with an electroacoustic transducer of the type defined in the first paragraph, the diaphragm and the supporting means for the diaphragm form a single part and the annular outer zone of the diaphragm and the first annular zone of the supporting means adjoin one another smoothly.

The integrated construction of the diaphragm and supporting means for the diaphragm results in a simple construction which can be manufactured at low cost. Moreover, it enables a very accurate configuration to be obtained, as a result of which it is always guaranteed that the voice coil of the transducer in accordance with the invention, which is connected to the diaphragm, is always positioned accurately in the air gap of the magnet system of the transducer in accordance with the invention and can thus always move freely in this air gap. The measures in accordance with the invention are particularly advantageous in the case of electroacoustic transducers of very small construction because in the case of such a miniaturized electroacoustic transducer it is substantially impossible to join such a diaphragm and such supporting means constructed as separate parts to one another in a sufficiently accurate manner owing to the small dimensions of the diaphragm and of the supporting means for diaphragm and owing to the small material thickness of the diaphragm and the small material thickness of the supporting means. With such a miniaturized electroacoustic transducer it is therefore particularly advantageous to construct the diaphragm and the corrugated supporting means, which are oriented substantially in the axial direction of the transducer, as a single part.

In a transducer in accordance with the invention having the characteristic features defined in the independent claim 1 the diaphragm and the supporting means can be formed by a single part which is manufactured by means of an injection-molding process. However, in a transducer in accordance with the invention having the characteristic features defined in the independent claim 1 it has proved to be particularly advantageous if, in addition, the measures defined in the dependent claim 2 are taken. In comparison with a molding process such a deep-drawing process requires substantially simpler dies. Furthermore, an advantage which is particularly important in the present context is that by means of a deep-drawing process a diaphragm including its supporting means can be manufactured with high precision using a very small material thickness of the order of magnitude of only a few hundredths of millimeters and with a properly reproducible thickness variation, which is of great importance particularly for miniaturized transducers. It is to be noted that for the manufacture of a diaphragm including its supporting means with the aid of a deep-drawing process it is possible to use, for example, a basic foil of polycarbonate.

In a transducer in accordance with the invention having the characteristic features defined in the independent claim 1 it has further proved to be very advantageous if, in addition, the measures defined in the dependent claim 3 are taken. In such an embodiment the compliance of the supporting means can be maximal in conjunction with a minimal dimension in the direction of vibration, which is advantageous in order to obtain good acoustic properties of the transducer. It is to be noted that the measures defined in the dependent claim 3 can also be applied advantageously in a transducer in accordance with the invention having the characteristic features defined in the dependent claim 2.

In a transducer in accordance with the invention having the characteristic features defined in the independent claim 1 it has also proved to be advantageous if, in addition, the measures defined in the dependent claim 4 are taken. Such an embodiment has proved to be very advantageous in practice, because it has the advantage of good acoustic properties. Moreover, it has the advantage that a maximal effective vibration area with a piston-like excursion in the direction of vibration is obtained for the diaphragm, which is advantageous in order to achieve a maximal radiation of acoustic power. It is to be noted that the measures defined in the dependent claim 4 can also be applied advantageously in transducers in accordance with the invention having the characteristic features defined in the dependent claims 2 and 3.

In a transducer in accordance with the invention having the characteristic features defined in the dependent claim 4 it has also proved to be advantageous if, in addition, the measures defined in the dependent claim 5 are taken. This guarantees particularly favorable and advantageous acoustic properties of a transducer in accordance with the invention.

In a transducer in accordance with the invention having the characteristic features defined in the dependent claim 4 it has further proved to be very advantageous if, in addition, the measures defined in the dependent claim 6 are taken. This is very favorable for a construction which is as simple as possible.

In a transducer in accordance with the invention having the characteristic features defined in the dependent claim 6 it has further proved to be very advantageous if, in addition, the measures defined in the dependent claim 7 are taken. Such a configuration of the intermediate zone with trough portions has the advantage that the intermediate zone contributes positively to the stiffness of the diaphragm. Moreover, these trough portions have the advantage that the voice coil, which is connected to the intermediate zone, can be small, light in weight and cheap.

In a transducer in accordance with the invention having the characteristic features defined in the dependent claim 7 it has further proved to be particularly advantageous if, in addition, the measures defined in the dependent claim 8 are taken. Owing to the provision of the first wedge portions and the second wedge portions the intermediate zone is stiffened additionally, which is advantageous both for a reliable connection of a voce coil to the diaphragm and for a diaphragm whose stiffness is inherently good.

In a transducer in accordance with the invention having the characteristic features defined in the independent claim 1 it has further proved to be very advantageous if, in addition, it has the characteristic features defined in the dependent claim 9. This has the advantage that a transducer in accordance with the invention also has advantages known per se—as in the electroacoustic transducer known from the document DE 1 085 1293. It is to be noted that the measures defined in the dependent claim 9 can also be applied advantageously to transducers in accordance with the invention as defined in the dependent claims 2, 3, 4, 5, 6, 7 and 8.

An electroacoustic transducer in accordance with the invention can also be constructed as a microphone. However, in a transducer in accordance with the invention having the characteristic features defined in the independent claim 1 it has proved to be particularly advantageous if it has the characteristic features defined in the dependent claim 10. This is because the advantages of a transducer in accordance with the invention are particularly manifest in a transducer constructed as a loudspeaker.

According to the invention, in order to achieve the afore-mentioned object with a diaphragm of the type defined in the second paragraph is characterized in that the diaphragm and the supporting means for the diaphragm form a single part and the annular outer zone of the diaphragm and a first annular zone of the supporting means adjoin one another smoothly, and the supporting means have a second annular zone for connection to a housing of an electroacoustic transducer and a connecting zone which connects the first annular zone and the second annular zone to one another, which connecting zone has an at least substantially corrugated cross-sectional shape and has an orientation which corresponds at least substantially to the direction of vibration of the diaphragm, and is further elastically compliant parallel to the direction of vibration of the diaphragm. In this way, advantages which correspond to the advantages described hereinbefore for a transducer in accordance with the invention having the characteristic features defined in the independent claim 1 are obtained for a diaphragm in accordance with the invention.

The advantageous variants of a diaphragm in accordance with the invention, which variants have the characteristic features defined in the dependent claims 12 to 19, yield advantages which correspond to the advantages described above for the advantageous variants of a transducer in accordance with the invention, which variants have the characteristic features defined in the dependent claims 2 to 9.

The above-mentioned as well as further aspects of the invention will become apparent from the embodiment described hereinafter by way of example and will be elucidated by means of this embodiment.

The invention will now be described in more detail with reference to the drawings, which show an example of an embodiment to which the invention is not limited.

FIG. 1 shows in a partly diagrammatic cross-sectional view to an enlarged scale—i.e. approximately 7 times full scale—an electroacoustic transducer in accordance with a first embodiment of the invention, which is constructed as a loudspeaker and which comprises a diaphragm in accordance with an embodiment of the invention.

FIG. 2, in a view similar to that of FIG. 1, shows the diaphragm and the diaphragm supporting means of the transducer of FIG. 1, which form a single part with the diaphragm.

Figure 4:
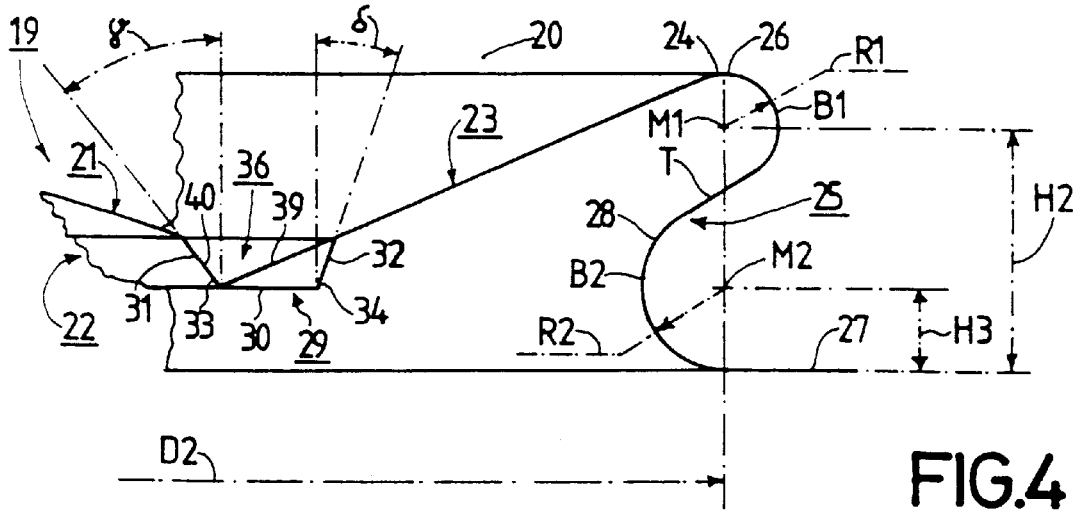
FIG. 4 shows a peripheral area of the diaphragm of FIG. 2 including the supporting means connected to the diaphragm in a view similar to that of FIG. 2 but to a substantially larger scale than FIG. 2.
Figure 5:
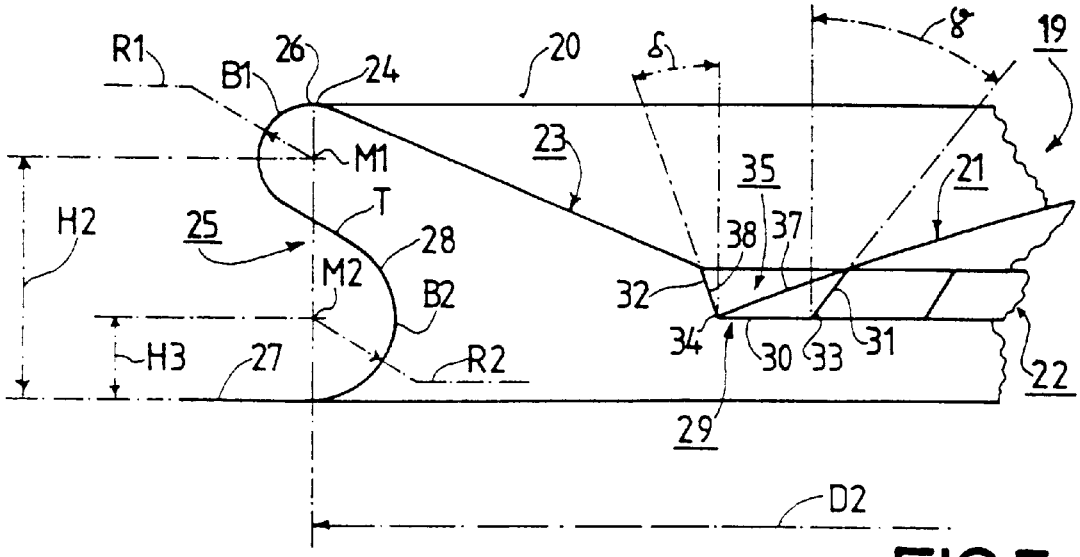

FIG. 5, in a view similar to that in FIG. 4, shows a further peripheral area of the diaphragm, which peripheral area is disposed diametrally opposite to the peripheral area shown in FIG. 4.

Figure 1:
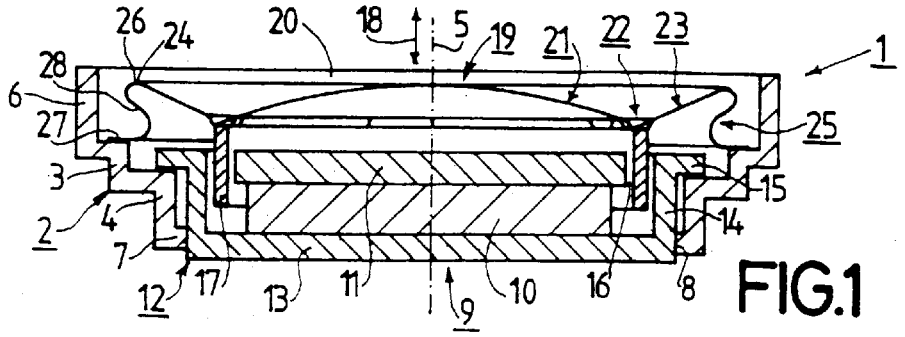
Figure 2:
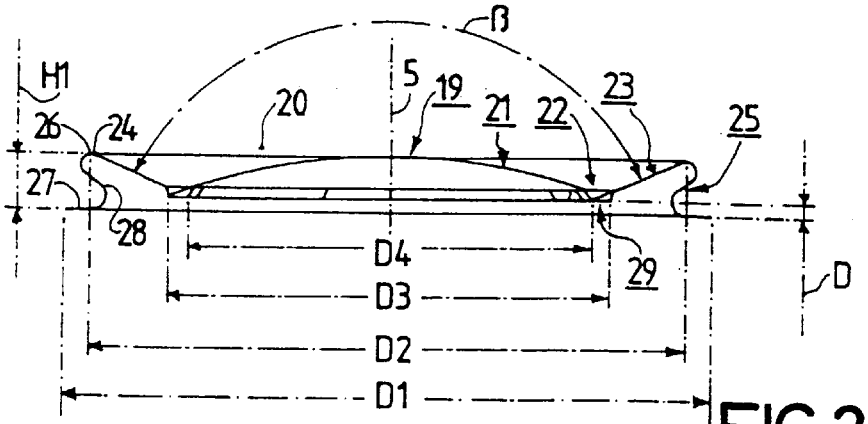

FIG. 1 shows an electroacoustic transducer 1, which is referred to briefly as the transducer 1 and is constructed as a loudspeaker. The transducer 1 comprises a plastic housing 2 having a first stepped portion 3 and a second stepped portion 4, which stepped portions 3 and 4 adjoin one another. A hollow cylindrical housing portion 6, which extends in the direction of a transducer axis 5, is connected to the first stepped portion 3. A plate-shaped housing portion 7 having a circularly cylindrical passage 8 is connected to the second stepped portion 4.

The transducer 1 has a magnet system 9. The magnet system 9 comprises a magnet 10 and a pole plate 11 and a pot 12, often referred to as outer pot and comprising a pot bottom 13, a hollow cylindrical pot portion 14 and a pot collar 15 which projects radially from the pot portion 14. The entire magnet system 9 is secured to the second stepped portion 4 of the housing 2 by the pot collar 15 of the pot 12 in that an adhesive joint is formed between the pot collar 15 and the second stepped portion 4. The pot 12 of the magnet system 9 extends with its pot bottom 13 through the passage 8 in the plate-shaped housing portion 7, a mechanically and acoustically imperforate joint being formed by a press-fit between the plate-shaped housing portion 7 and the pot 12, but this joint may alternatively be an adhesive joint.

Between the circumferential bounding surface of the pole plate 11 and the surface of the hollow cylindrical pot portion 14 which faces the pole plate 11 an air gap 16 is formed. A voice coil 17 of the transducer 1 is disposed partly in the air gap 16. By means of the magnet system 9 the voice coil 17 can be set into vibration substantially parallel to a direction of vibration, which is indicated by means of a double arrow 18 and extends parallel to the transducer axis 5. The voice coil 17 is connected to a diaphragm 19 of the transducer 1, the construction of said diaphragm being described in detail hereinafter.

The diaphragm 19 of the transducer 1 serves to cooperate with an air mass in an acoustic free space situated in front of the diaphragm 19. By means of the voice coil 17 the diaphragm 19 can be set into vibration substantially parallel to the direction 18 of vibration.

In an advantageous manner the present diaphragm 19 has a substantially spherical central zone 21 which is convex with respect to the acoustic free space 20 disposed in front of the diaphragm 19. The diaphragm 19 further has a peripheral zone 23 which, in the present case, is frustoconical, diverging towards the acoustic free space 20 in front of the diaphragm 19, which peripheral zone is connected to the central zone 21 by an annular intermediate zone 22 and terminates in an annular outer zone 24 of the diaphragm 19. Advantageously, the construction of the diaphragm 19 is such that in spite of its division into the central zone 21, the intermediate zone 22 and the peripheral zone 23 the diaphragm 19 is inherently stiff, which is advantageous in view of good acoustic properties of the diaphragm 19 and, consequently, of the transducer 1. The annular intermediate zone 22 of the diaphragm 19 of the transducer 1 is adapted to secure the voice coil 17 of the transducer 1 to the diaphragm 19. The structure of the annular intermediate zone 22 and the connection of the voice coil 17 to this intermediate zone 22 is described in detail hereinafter.

To secure the diaphragm 19 to the housing 2 the transducer 1 has supporting means 25. The supporting means 25 comprise a first annular zone 26 connected to the annular outer zone 24 of the diaphragm 19, a second annular zone 27 connected to the housing 2, namely to the first stepped portion 3, and a connecting zone 28 which connects the first annular zone 26 and the second annular zone 27 to one another. The connecting zone 28 has a corrugated cross-sectional shape. The orientation of the connecting zone 28 corresponds at least substantially to the direction 18 of vibration of the diaphragm 19. With respect to the connecting zone 28 it is to noted that the connecting zone 28 is elastically compliant parallel to the direction 18 of vibration of the diaphragm 19.

Advantageously, the diaphragm 19 and the supporting means 25 for the diaphragm 19 form a single part, as is apparent from the FIGS. 1 to 5. The annular outer zone 24 of the diaphragm 19 and the first annular zone 26 of the supporting means 25 adjoin one another smoothly, as is apparent from FIGS. 4 and 5. Since the diaphragm 19 and the supporting means 25 for the diaphragm 19 form a single part, it is achieved that the diaphragm 19 including its supporting means 25 can be connected to the housing 2 of the transducer 1 in a single operation. In order to connect the supporting means 25 to the housing 2 an adhesive joint is formed between the second annular zone 27 of the supporting means 25 and the first stepped portion 3 of the housing 2. Moreover, since the diaphragm 19 and the supporting means 25 for the diaphragm 19 form a single part, a very accurate construction for the diaphragm 19 including the supporting means 25 as well as a very accurate positioning of the diaphragm 19 in the housing 2 of the transducer 1 and, consequently, a very accurate positioning of the voice coil 17, which is connected to the diaphragm 19, are guaranteed, which is important and advantageous for a correct operation of the transducer 1.

In the transducer 1 shown in FIG. 1 the diaphragm 19 and the supporting means 25, which form a single part, have been manufactured by means of a deep-drawing process. In the present case, such a deep-drawing process is of great advantage because such a deep-drawing process enables the diaphragm 19 and the supporting means 25 for the diaphragm 19 to be manufactured with very thin walls and yet with a uniform material thickness, as a result of which a very light-weight diaphragm 19 can be obtained, which is particularly important and advantageous in the present case of a miniaturized transducer.

In the transducer 1 shown in FIG. 1 the construction of the supporting means 25 is such that the connecting zone of the supporting means 25 is cross-sectionally S-shaped. Furthermore, as regards the supporting means 25 it is to be noted that - viewed parallel to the direction 18 of vibration of the diaphragm 19—the connecting zone 28 of the supporting means 25 has such a dimension that the second annular zone 27 of the supporting means 25, which zone is connected to the housing 2, is spaced at a given distance D from the diaphragm 19 in a direction parallel to the direction 18 of vibration and away from the acoustic free space 20 situated in front of the diaphragm 19, as is apparent from FIGS. 4 and 5. The S-shape of the connecting zone 28 and the fact that the second annular zone 27 is spaced from the diaphragm 19 result in the advantage that compliant supporting means 25 are obtained, which is advantageous in view of good acoustic properties of the transducer 1.

Hereinafter, the annular intermediate zone 22 of the diaphragm 19 will be described in more detail. The intermediate zone 22 serves for securing the voice coil 17 of the transducer 1 to the diaphragm 19. Thus, the intermediate zone forms a mounting zone for securing the voice coil 17.

Figure 3:
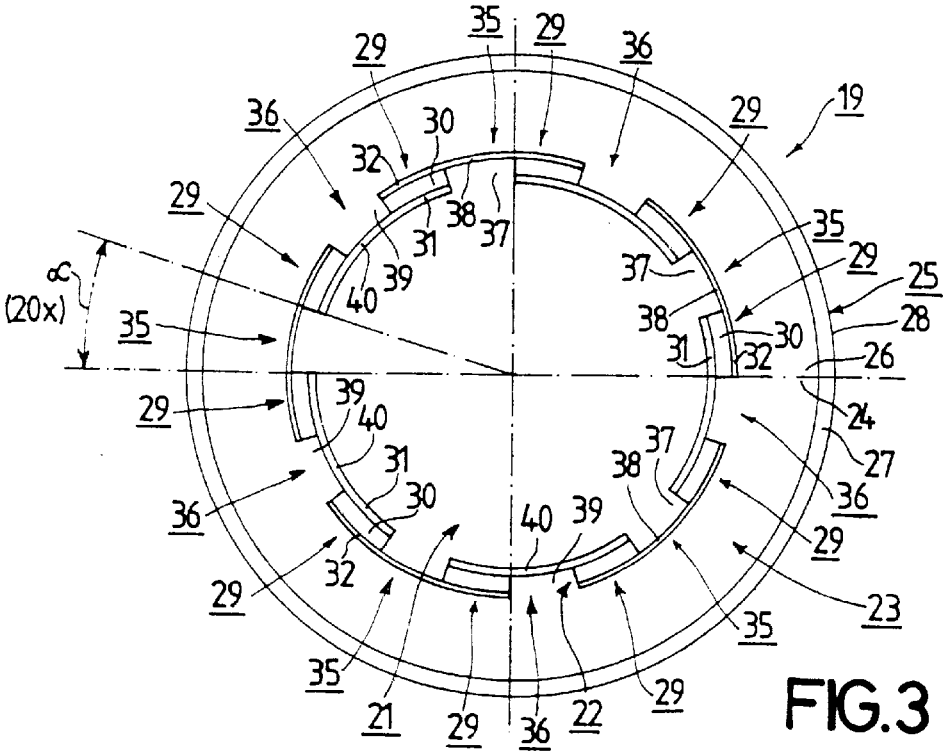
FIG. 3 is a plan view which shows the diaphragm of FIG. 2 including its supporting means.

The annular intermediate zone 22 has angularly equispaced trough portions 29, as is apparent from FIGS. 3, 4 and 5. In the present case, the trough portions 29 are equispaced at angles $\alpha$ of 18° from one another. As a result of this, the diaphragm 19 has ten (10) such trough portions 29 in total. The trough portions 29 are trough-shaped in cross-section. The trough portions 29 are each bounded by a trough bottom wall 30 and two trough side walls 31 and 32. Of the trough side walls 31 and 32 each radially inner trough side wall 31 adjoins the spherical central zone 21 and each radially outer trough side wall 32 adjoins the diverging peripheral zone 23. The trough portions are constructed in such a manner that in each of these trough portions 29 the trough bottom wall 30 is connected to the trough side walls 31 and 32 at those ends 33 and 34 of the trough side walls 31 and 32 which are remote from the free space 20 in front of the diaphragm 19.

The trough bottom walls 30 of the trough portions 29 form the actual mounting zone on the diaphragm 19 for securing the voice coil 17 of the transducer 1 to the diaphragm 19. The voice coil 17 is secured to the trough bottom walls 30, which are disposed in a plane perpendicular to the transducer axis 5, by means of an adhesive joint formed between each respective trough bottom wall 30 and the voice coil 17. Ten (10) adhesive joints in total between the ten (10) trough bottom walls 30 and the voice coil 17 guarantee a reliable connection of the voice coil 17 to the diaphragm 19. Securing the voice coil 17 to the trough bottom walls 30 has the advantage that excess adhesive applied in order to form an adhesive joint can escape to the areas between the trough bottom walls 30, so that un undesired egress of excess adhesive is avoided.

Another advantageous feature of the transducer 1 is that—viewed in a tangential direction—a first wedge portion 35 adjoins each trough portion 29 at one end and a second wedge portion 36 at the other end. Each first wedge portion 35 is bounded by a radial prolongation 37 of the spherical central zone 21 of the diaphragm 19 and by a tangential prolongation 38 of the radially outer trough side wall 32 of the adjacent trough portion 29. Each second wedge portion 36 is bounded by a radial prolongation 39 of the diverging peripheral zone 23 of the diaphragm 19 and by a tangential prolongation 40 of the radially inner trough side wall 31 of the adjacent trough portion 29. The wedge portions 35 and 36 promote the stiffness of the annular intermediate zone 22 and thus of the entire diaphragm 19, which is advantageous in view of good acoustic properties of the transducer 1.

By forming the annular intermediate zone 22 with the aid of the trough portions 29 the advantage is obtained in the transducer 1 that the actual mounting zone for the voice coil 17, which zone is formed by the trough bottom walls 30 of the trough portions 29, is situated comparatively close to the air gap 16 of the magnet system 9 so that—in comparison with a known diaphragm having a flat annular intermediate zone—the dimension of the voice coil 17 in the direction of the transducer axis 5 can, in principle, be smaller by an amount equal to the depth of the trough portions. As a result of this, a comparatively short and therefore comparatively light-weight voice coil 17 is obtained, which requires only a comparatively small number of turns. Moreover, it is achieved that the voice coil 17 is disposed relatively symmetrically with respect to the air gap 16, which is advantageous in order to preclude non-linear distortion.

Hereinafter, some important dimensions of the diaphragm 19 and the supporting means 25 for the diaphragm 19 are discussed briefly. As is apparent from FIG. 2, the second annular zone 27 of the supporting means 25 has an outer diameter D1, which can be for example 12.4 mm. The inner diameter of the first annular zone 26 of the supporting means 25, which corresponds to the outer diameter of the annular outer zone 24 of the diaphragm 19, bears the reference symbol D2 in FIG. 2 and can for example be 11.4 mm. The frustoconical peripheral zone 23 has a flare angle $\beta$ of for example 132°. The trough bottom walls 30 of the trough portions 29 are situated between two diameters referenced D3 and D4 in FIG. 2. The diameter D3 can be 8.4 mm and the diameter D4 can be 7.7 mm for example. The radially inner trough side walls 31 have an angle of inclination $\gamma$ of, for example, 38.5°. The radially outer trough side walls 32 have an angle of inclination $\delta$ of, for example 19°. As is also apparent from FIG. 2, the supporting means 25 have an overall height H1 in the direction of the transducer axis 5, which can be, for example, 1.1 mm. Said spacing, i.e. the distance D between the second annular zone 27 of the supporting means 25 and the diaphragm 19 can, for example, be 0.3 mm.

As is apparent from FIGS. 4 and 5, The S-shape of the connecting zone 28 of the supporting means 25 corresponds to an arc of circle B1 having a radius R1 and starting from the first annular zone 26, an arc of circle B2 having a radius R2 and starting from the second annular zone 27 , and a tangent line T which joins the two arcs of circle B1 and B2 to one another. The radius R1 can then for example be 0.2 mm and the radius R2 can then for example be 0.3 mm. The distance H2 from the center M1 of the arc of circle B1 to the axial level of the second annular zone 27 can be for example 0.9 mm. The distance H3 from the center M2 of the arc of circle B3 to the axial level of the second annular zone 27 can be for example 0.3 mm.

The invention is not limited to the embodiment described hereinbefore by way of example. Alternatively, the supporting means 25 can be of a construction in which the connecting zone of the supporting means 25 is cross-sectionally bellows-shaped instead of S-shaped and can be made up of at least three or also four arc of circle portions. Furthermore, a zigzag shaped construction is possible for the connecting zone of the supporting means 25. The diaphragm 19 can also be of another construction. For example, the annular intermediate zone 22 between the central zone 21 and the peripheral zone 23 can alternatively be a simple round disc-shaped intermediate zone. The peripheral zone 23 of the diaphragm 19 can have a toroidal shape instead of a frustoconical shape. Instead of a spherical shape the central zone 21 can have another convex shape.

What is claimed is:

1. An electroacoustic transducer comprising a housing, a voice coil, and a diaphragm for cooperating with an air mass in an acoustic free space situated in front of the diaphragm, said diaphragm capable of being set into vibration by the voice coil substantially parallel to an axis of said electroacoustic transducer, said diaphragm further comprising an annular outer zone and supporting means for securing the diaphragm to the housing, said supporting means having a first annular zone connected to the annular outer zone of the diaphragm, a second annular zone connected to the housing, and a connecting zone which connects the first annular zone to the second annular zone, said connecting zone having an, at least substantially, corrugated cross-sectional shape, and having an orientation corresponding, at least substantially, to the direction of vibration of the diaphragm, and being further elastically compliant parallel to the direction of vibration of the diaphragm, characterized in that the diaphragm and the supporting means form a single part, the annular outer zone of the diaphragm and the first annular zone of the supporting means adjoin one another smoothly, and, viewed transverse to the direction of vibration of the diaphragm, the connecting zone of the supporting means has a dimension such that the second annular zone of the supporting means, said second annular zone being connected to the housing, is spaced at a given distance below a bottom-most part of the diaphragm in a direction parallel to the direction of vibration and away from the acoustic free space situated in front of the diaphragm.

2. The electroacoustic transducer as claimed in claim 1, characterized in that the diaphragm and the supporting means, which form a single part, are manufactured by a deep-drawing process.

3. The electroacoustic transducer as claimed in claim 1, characterized in that the diaphragm has a central zone which is convex with respect to the acoustic free space situated in front of the diaphragm, and has a peripheral zone which diverges towards the acoustic free space in front of the diaphragm, said peripheral zone being connected to the central zone by an annular intermediate zone, terminating in the outer zone of the diaphragm, and smoothly adjoining the first annular zone of the supporting means.

4. The electroacoustic transducer as claimed in claim 3, characterized in that in spite of being divided into the central zone, the intermediate zone and the peripheral zone, the diaphragm is inherently stiff.

5. The electroacoustic transducer as claimed in claim 3, characterized in that the annular intermediate zone of the diaphragm is constructed for securing the voice coil of the electroacoustic transducer to the diaphragm.

6. The electroacoustic transducer as claimed in claim 5, characterized in that the annular intermediate zone has angularly spaced-apart trough portions which are substantially trough-shaped in cross-section and which are each bounded by a trough bottom wall and radially inner and outer trough side walls, of which each radially inner trough side wall adjoins the central zone, and each radially outer trough side wall adjoins the peripheral zone, and in each of these trough portions, the trough bottom wall is connected to the radially inner and outer trough side walls at those ends of the radially inner and outer trough side walls which are remote from the free space in front of the diaphragm.

7. The electroacoustic transducer as claimed in claim 6, characterized in that, viewed in a tangential direction, a first wedge portion adjoins each trough portion at one end, and a second wedge portion adjoins each trough portion at the other end, and each first wedge portion is bounded by a radial prolongation of the central zone of the diaphragm and by a tangential prolongation of the radially outer trough side wall of the adjacent trough portion, and each second wedge portion is bounded by a radial prolongation of the peripheral zone of the diaphragm and by a tangential prolongation of the radially inner trough side wall of the adjacent trough portion.

8. The electroacoustic transducer as claimed in claim 1, characterized in that the connecting zone of the supporting means is substantially S-shaped in cross-section.

9. The electroacoustic transducer as claimed in claim 1, characterized in that the electroacoustic transducer is a loudspeaker.

10. A diaphragm for an electroacoustic transducer, said diaphragm being intended for cooperation with an air mass in an acoustic free space situated in front of the diaphragm, said diaphragm capable of being set into vibration by a voice coil substantially parallel to an axis of the diaphragm, said diaphragm comprising an annular outer zone for securing the diaphragm to supporting means, said supporting means securing the diaphragm to a housing of an electroacoustic transducer, characterized in that the diaphragm and the supporting means form a single part, the annular outer zone of the diaphragm and a first annular zone of the supporting means adjoin one another smoothly, the supporting means has a second annular zone for connecting the diaphragm to the housing of the electroacoustic transducer, and a connecting zone for connecting the first annular zone to the second annular zone to one another, said connecting zone having an, at least substantially, corrugated cross-sectional shape, and having an orientation corresponding, at least substantially, to the direction of vibration of the diaphragm, and being further elastically compliant parallel to the direction of vibration of the diaphragm, and, viewed transverse to the direction of vibration of the diaphragm, the connecting zone of the supporting means has a dimension such that the second annular zone of the supporting means, said second annular zone being connected to the housing, is spaced at a given distance below a bottom-most part of the diaphragm in a direction parallel to the direction of vibration and away from the acoustic free space situated in front of the diaphragm.

11. The diaphragm as claimed in claim 10, characterized in that the diaphragm and the supporting means, which form a single part, are manufactured by a deep-drawing process.

12. The diaphragm as claimed in claim 10, characterized in that the diaphragm has a central zone which is convex with respect to the acoustic free space situated in front of the diaphragm, and has a peripheral zone which diverges towards the acoustic free space in front of the diaphragm, said peripheral zone being connected to the central zone by an annular intermediate zone, terminating in the outer zone of the diaphragm, and smoothly adjoining the first annular zone of the supporting means.

13. The diaphragm as claimed in claim 12, characterized in that in spite of being divided into the central zone, the intermediate zone and the peripheral zone, the diaphragm is inherently stiff.

14. The diaphragm as claimed in claim 12, characterized in that the annular intermediate zone of the diaphragm is constructed for securing the voice coil of the electroacoustic transducer to the diaphragm.

15. The diaphragm as claimed in claim 14, characterized in that the annular intermediate zone has angularly spaced-apart trough portions which are substantially trough-shaped in cross-section and which are each bounded by a trough bottom wall and radially inner and outer trough side walls, of which each radially inner trough side wall adjoins the central zone, and each radially outer trough side wall adjoins the peripheral zone, and in each of these trough portions, the trough bottom wall is connected to the radially inner and outer trough side walls at those ends of the radially inner and outer trough side walls which are remote from the free space in front of the diaphragm.

16. The diaphragm as claimed in claim 15, characterized in that, viewed in a tangential direction, a first wedge portion adjoins each trough portion at one end, and a second wedge portion adjoins each trough portion at the other end, and each first wedge portion is bounded by a radial prolongation of the central zone of the diaphragm and by a tangential prolongation of the radially outer trough side wall of the adjacent trough portion, and each second wedge portion is bounded by a radial prolongation of the peripheral zone of the diaphragm and by a tangential prolongation of the radially inner trough side wall of the adjacent trough portion.

17. The diaphragm as claimed in claim 10, characterized in that the connecting zone of the supporting means is substantially S-shaped in cross-section.

* * * * *